US006801632B2

(12) United States Patent
Olson

(10) Patent No.: US 6,801,632 B2
(45) Date of Patent: Oct. 5, 2004

(54) MICROPHONE ASSEMBLY FOR VEHICULAR INSTALLATION

(75) Inventor: Bradley F. Olson, Park Ridge, IL (US)

(73) Assignee: Knowles Electronics, LLC, Itasca, IL (US)

( * ) Notice: Subject to any disclaimer, the term of this patent is extended or adjusted under 35 U.S.C. 154(b) by 513 days.

(21) Appl. No.: 09/974,730

(22) Filed: Oct. 10, 2001

(65) Prior Publication Data

US 2003/0068060 A1 Apr. 10, 2003

(51) Int. Cl.[7] ..... H04R 25/00

(52) U.S. Cl. ..... 381/365; 381/361; 381/366; 439/500

(58) Field of Search ..... 381/355, 360, 381/361, 365, 86, 91, 92, 122, 366; 455/569.1, 569.2, 575.9, 345; 439/500, 626; 379/433.03, 433.05

(56) References Cited

U.S. PATENT DOCUMENTS

| | | | | |
|---|---|---|---|---|
| 4,768,870 A | | 9/1988 | Chen | 350/631 |
| 4,930,742 A | | 6/1990 | Schofield et al. | 248/475.01 |
| 4,956,867 A | | 9/1990 | Zurek et al. | 381/94.1 |
| 5,214,707 A | | 5/1993 | Fujimoto et al. | 381/43 |
| 5,353,376 A | | 10/1994 | Oh et al. | 395/2.42 |
| 5,463,694 A | | 10/1995 | Bradley et al. | 381/91 |
| 5,627,799 A | | 5/1997 | Hoshuyama | 367/121 |
| 5,649,317 A | | 7/1997 | Suzuki | 455/345 |
| 5,778,082 A | | 7/1998 | Chu et al. | 381/92 |
| 5,798,688 A | | 8/1998 | Schofield | 340/438 |
| 5,823,820 A | * | 10/1998 | Patel et al. | 439/500 |
| 5,825,898 A | | 10/1998 | Marash | 381/92 |
| 5,830,007 A | * | 11/1998 | Fry et al. | 439/500 |
| 5,835,608 A | | 11/1998 | Warnaka et al. | 381/94.7 |
| 5,940,503 A | | 8/1999 | Palett et al. | 379/454 |
| 6,009,396 A | | 12/1999 | Nagata | 704/270 |
| 6,026,162 A | | 2/2000 | Palett et al. | 379/454 |
| 6,192,134 B1 | | 2/2001 | White et al. | 381/92 |
| 6,278,377 B1 | | 8/2001 | DeLine et al. | 340/815.4 |

FOREIGN PATENT DOCUMENTS

| | | |
|---|---|---|
| SG | PCT/SG 99/00119 | 3/2000 |
| WO | WO 00/30264 | 5/2000 |

* cited by examiner

*Primary Examiner*—Huyen Le
(74) *Attorney, Agent, or Firm*—Marshall, Gerstein & Borun LLP

(57) ABSTRACT

A microphone assembly for installation on a surface in a cabin of a vehicle to electrically couple the microphone with a vehicular communication system is disclosed. The assembly comprises a microphone having an outer surface and a plurality of microphone contacts fixedly secured to the outer surface and means for securing the microphone to the surface in an orientation to electrically couple the plurality of microphone contacts to a respective plurality of fixedly secured system contacts to couple the microphone with the vehicular communication system.

30 Claims, 2 Drawing Sheets

MICROPHONE ASSEMBLY FOR VEHICULAR INSTALLATION

CROSS-REFERENCE TO RELATED APPLICATIONS

None.

FEDERALLY SPONSORED RESEARCH OR DEVELOPMENT

Not Applicable.

TECHNICAL FIELD

This invention relates to the installation of a microphone in a vehicular cabin, such as in a rear view mirror, head-liner, or the like.

BACKGROUND OF THE INVENTION

For some time now, microphone assemblies, containing one or more microphones have been installed in automobiles for communicating with a vehicular communication system, such as for a hands-free cellular phone system. These microphone assemblies are frequently placed in a rear-view mirror, head-liner, overhead console, or the like, and change an acoustical signal into an electrical signal, and then pass the electrical signal on, either as-is, or with amplification and/or signal processing. The microphone assembly must in some manner be electrically coupled to the balance of the vehicular communication system. Typically this is accomplished with a cable which must be manually attached to a mating connector on the mirror. See, for example, DeLine et al., U.S. Pat. No. 6,278,377 and Schofield, U.S. Pat. No. 5,798,688.

It has been found to be difficult to make this electrical connection properly, which adds cost and complexity to both the design, as well as to the assembly process.

In some circumstances, the microphone assembly may be directional, where the exact orientation of the microphone is critical. Prior art microphone assemblies could be installed in an incorrect orientation.

Additionally, all these extra connecting parts on the microphone assembly and in the mirror assembly add no value in terms of the acoustical performance of the system.

The present invention is provided to solve these and other problems.

SUMMARY OF THE INVENTION

It is an object of the invention to provide a microphone assembly for installation on a surface in a cabin of a vehicle to electrically couple the microphone with a vehicular communication system.

In accordance with the invention, the assembly comprises a microphone having an outer surface and a plurality of microphone contacts fixedly secured to the outer surface and means for securing the microphone to the surface in an orientation to electrically couple the plurality of microphone contacts to a respective plurality of fixedly secured system contacts to couple the microphone with the vehicular communication system.

It is contemplated that the microphone contacts may be spring biased.

It is further contemplated that the securing means comprises a threaded outer surface to engage a threaded vehicular surface, or an interference fit there between. The securing means may include locating protrusions for rotationally positioning the microphone relative to the vehicular surface.

It is still further contemplated that the vehicular surface is a part of a rear-view mirror, a vehicular head-liner, a vehicular overhead console, or the like.

In one embodiment, it is contemplated that the microphone assembly has a peripheral surface and the contacts are located on the peripheral surface.

In another embodiment, the microphone has a base surface and the contacts are located on the base surface.

It is a further object of the invention to provide a method of installing a microphone on a surface in a cabin of a vehicle to electrically couple the microphone with a vehicular communication system.

According to this aspect of the invention, the method comprises providing a microphone having an outer surface and a plurality of microphone contacts fixedly secured to the outer surface, providing a surface in the vehicular cabin having a respective plurality of fixedly secured system contacts electrically coupled to the vehicular communication system, and securing the microphone to the surface in an orientation to electrically couple the plurality of microphone contacts to the respective plurality of fixedly secured system contacts to electrically couple the microphone with the vehicular communication system.

These and other aspects and attributes of the present invention will be discussed with reference to the following drawings and accompanying specification.

DETAILED DESCRIPTION OF THE INVENTION

Figure 1:
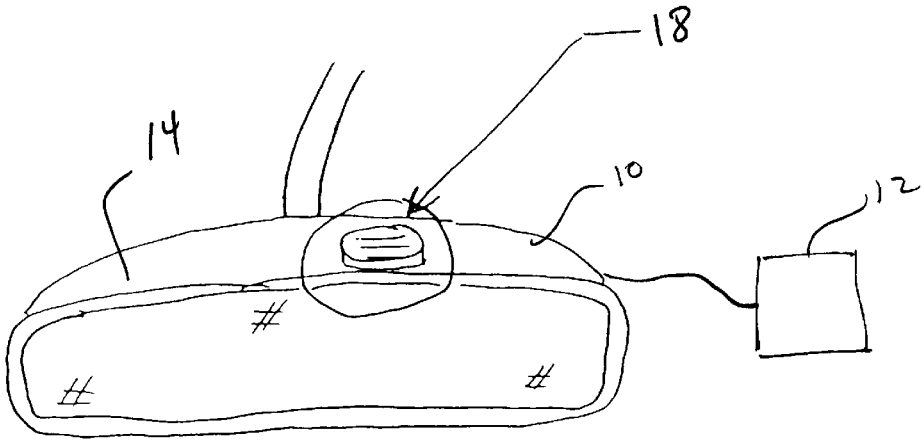
FIG. 1 illustrates a microphone assembly installed in a rear-view mirror in accordance with the invention.

While this invention is susceptible of embodiment in many different forms, there is shown in the drawing, and will be described herein in detail, specific embodiments thereof with the understanding that the present disclosure is to be considered as an exemplification of the principles of the invention and is not intended to limit the invention to the specific embodiments illustrated.

A rear view mirror assembly 10 for communicatively coupling a vehicular passenger with a vehicular communication system 12 is illustrated in FIG. 1. The mirror assembly 10 comprises a mirror housing 14 having a housing surface 14*a* and a plurality of fixedly secured mirror contacts 16 (FIG. 2) electrically coupled with the vehicular communication system 12. A microphone 18 having an outer surface 18*a* and a respective plurality of microphone contacts 20 are fixedly secured to the outer surface 18*a*.

Means are provided for securing the microphone 18 to the housing surface 14*a* in an orientation to electrically couple the plurality of microphone contacts 20 to the respective plurality of fixedly secured mirror contacts 16 to couple the microphone 18 with the vehicular communication system 12. The microphone contacts 20 may be solid or spring biased.

Figure 4:
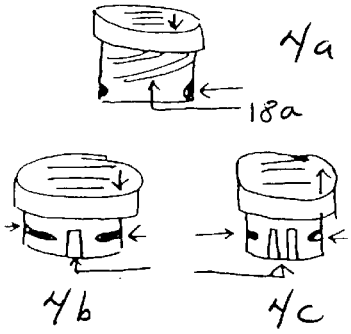
FIGS. 4*a,b,c* and *d* illustrate other mounting configurations of the microphone assembly in accordance with the invention.
Figure 4:
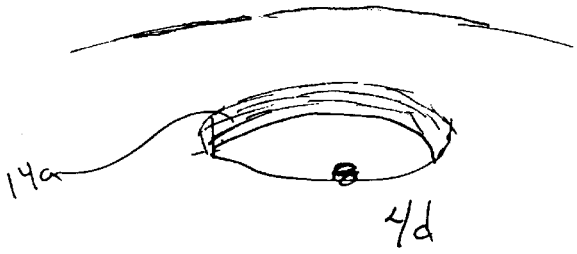

In a first embodiment illustrated in FIG. 4*a*, the securing means comprises cooperatively threaded surfaces on the microphone outer surface 18*a* and the mirror housing surface 14*a*. The threading is aligned so that when the microphone 18 is fully screwed in, the microphone contacts 20 are in contact with the mirror contacts 16.

Figure 2:
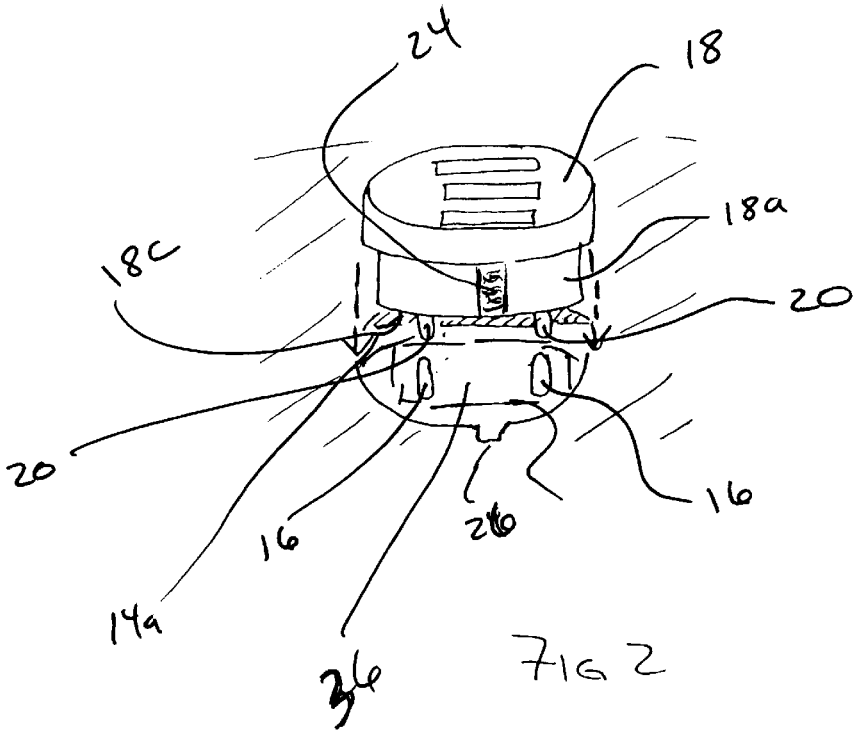
FIG. 2 is an enlarged portion of FIG. 1, illustrating a first embodiment of the invention.

In a second embodiment illustrated in FIG. 2, the securing means comprises an interference fit between the microphone outer surface 18*a* and the mirror housing surface 14*a*. In this embodiment, the microphone assembly 18 includes a protrusion 24 to fit into a cooperative slot 26 in the mirror assembly 14 to insure proper orientation of the microphone assembly 18.

Figure 3:
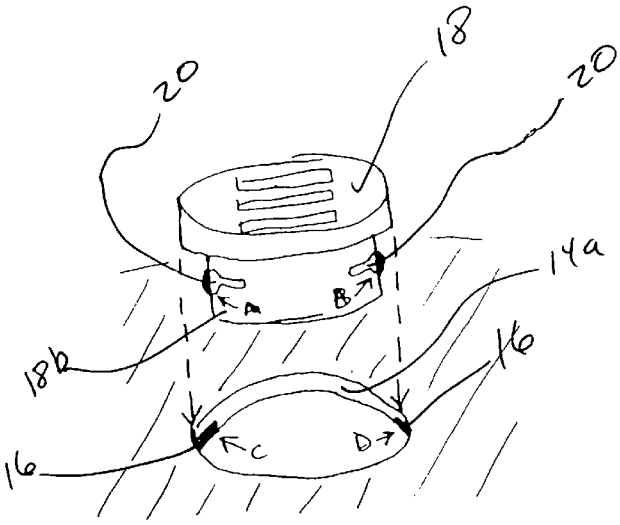
FIG. 3 illustrates one mounting configuration for the microphone assembly according to the invention.

In one embodiment of the invention as shown in FIG. 3, the microphone assembly 18 has a peripheral surface 18*b* and the microphone contacts 20 are located on the peripheral surface. In this embodiment, the mirror contacts 16 are located on the inner surface 14*a* of the mirror housing 14.

In another embodiment shown in FIG. 2, the microphone assembly 18 has a base surface 18*c* and the microphone contacts 20 are located on the base surface 18*c*. In this embodiment, the mirror contacts 16 are located inside the mirror housing, such as on a printed circuit board 36.

Figure 5:
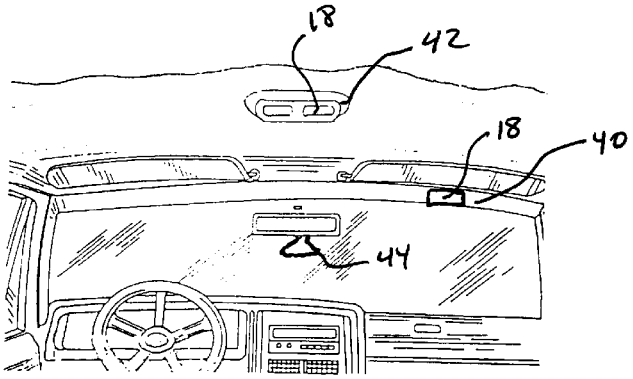
FIG. 5 illustrates the microphone assembly installed in other locations of a vehicular cabin.

Referring to FIG. 5, the microphone assembly 18 may be located in other areas of the vehicular cabin, such as a vehicular head-liner 40, an overhead console 42 or in a pod 44, such as depending from a mirror 14.

It should be understood that the microphone assembly 18 may be installed from either side of the surface, i.e., from the inside out, or the outside in.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A microphone assembly for installation on a surface in a cabin of a vehicle to electrically couple the microphone with a vehicular communication system, the assembly comprising:

a microphone having an outer surface and a plurality of microphone contacts fixedly secured to the outer surface;

means for securing the microphone to the surface in an orientation to electrically couple the plurality of microphone contacts to a respective plurality of fixedly secured system contacts to couple the microphone with the vehicular communication system.

2. The assembly of claim 1, wherein the microphone contacts are spring biased.

3. The assembly of claim 1, wherein the securing means comprises a threaded outer surface to engage a threaded vehicular surface.

4. The assembly of claim 1, wherein the securing means comprises an interference fit.

5. The assembly of claim 1, wherein the vehicular surface is a part of a rear-view mirror.

6. The assembly of claim 1, wherein the vehicular surface is a part of a vehicular head-liner.

7. The assembly of claim 1, wherein the vehicular surface is a part of a vehicular overhead console.

8. The assembly of claim 1, wherein the vehicular surface is a part of a vehicular pod.

9. The assembly of claim 1, wherein the securing means includes locating pins for rotationally positioning the microphone relative to the vehicular surface.

10. The assembly of claim 1, wherein the microphone has a peripheral surface and the threaded outer surface is the peripheral surface.

11. The assembly of claim 1, wherein the microphone has a peripheral surface and the contacts are located on the peripheral surface.

12. The assembly of claim 1, wherein the microphone has a base surface and the contacts are located on the base surface.

13. A method of installing a microphone on a surface in a cabin of a vehicle to electrically couple the microphone with a vehicular communication system, the method comprising:

providing a microphone having an outer surface and a plurality of microphone contacts fixedly secured to the outer surface;

providing a surface in the vehicular cabin having a respective plurality of fixedly secured system contacts electrically coupled to the vehicular communication system;

securing the microphone to the surface in an orientation to electrically couple the plurality of microphone contacts to the respective plurality of fixedly secured system contacts to electrically couple the microphone with the vehicular communication system.

14. The method of claim 13, wherein the microphone contacts are spring biased.

15. The method of claim 13, wherein:

the microphone is provided with a threaded outer surface;

the vehicular surface is provided with a corresponding threaded vehicular surface; and the microphone is secured to the vehicular surface screwing the microphone threaded outer surface into the threaded vehicular surface.

16. The method of claim 13, wherein the microphone is secured to the vehicular surface by an interference fit.

17. The method of claim 13, wherein the vehicular surface is a part of a rear-view mirror.

18. The method of claim 14, wherein the vehicular surface is a part of a vehicular head-liner.

19. The method of claim 13, wherein the vehicular surface is a part of a vehicular overhead console.

20. The method of claim 13, wherein the vehicular surface is a part of a vehicular pod.

21. The method of claim 13, wherein the securing means includes locating pins for rotationally positioning the microphone relative to the vehicular surface.

22. The method of claim 13, wherein the microphone has a peripheral surface and the threaded outer surface is the peripheral surface.

23. The method of claim 13, wherein the microphone has a peripheral surface and the contacts are located on the peripheral surface.

24. The method of claim 13, wherein the microphone has a base surface and the contacts are located on the base surface.

25. A rear view mirror assembly for communicatively coupling a vehicular passenger with a vehicular communication system, the mirror assembly comprising:

a mirror housing having a housing surface and a plurality of fixedly secured mirror contacts electrically coupled with the vehicular communication system;

a microphone having an outer surface and a respective plurality of microphone contacts fixedly secured to the outer surface; and means for securing the microphone to the housing surface in an orientation to electrically couple the plurality of microphone contacts to the respective plurality of fixedly secured mirror contacts to couple the microphone with the vehicular communication system.

26. The assembly of claim 25, wherein the securing means comprises cooperatively threaded surfaces on the microphone outer surface and the mirror housing surface.

27. The assembly of claim 25, wherein the securing means comprises an interference fit between the microphone outer surface and the mirror housing surface.

28. The assembly of claim 25, wherein the securing means includes locating pins for rotationally positioning the microphone relative to the mirror housing surface.

29. The assembly of claim 25, wherein the microphone has a peripheral surface and the contacts are located on the peripheral surface.

30. The assembly of claim 25, wherein the microphone has a base surface and the contacts are located on the base surface.

* * * * *

UNITED STATES PATENT AND TRADEMARK OFFICE

CERTIFICATE OF CORRECTION

PATENT NO. : 6,801,632 B2
DATED : October 5, 2004
INVENTOR(S) : Bradley F. Olson It is certified that error appears in the above-identified patent and that said Letters Patent is hereby corrected as shown below:

Column 3,
Line 65, please delete "The assembly of claim 1," and insert -- The assembly of claim 3, --.

Column 4,
Line 45, please delete "The method of claim 13," and insert -- The assembly of claim 15, --.

Signed and Sealed this

Fifteenth Day of March, 2005

JON W. DUDAS
*Director of the United States Patent and Trademark Office*